US010800051B2

(12) United States Patent
Ronan et al.

(10) Patent No.: US 10,800,051 B2
(45) Date of Patent: Oct. 13, 2020

(54) UTILITY KNIFE

(71) Applicants: John Ronan, Temecula, CA (US); Wayne Biggs, Hemet, CA (US)

(72) Inventors: John Ronan, Temecula, CA (US); Wayne Biggs, Hemet, CA (US)

(73) Assignee: Ronan Tools

( * ) Notice: Subject to any disclaimer, the term of this patent is extended or adjusted under 35 U.S.C. 154(b) by 0 days.

(21) Appl. No.: 16/372,343

(22) Filed: Apr. 1, 2019

(65) Prior Publication Data

US 2019/0351565 A1 Nov. 21, 2019

Related U.S. Application Data

(60) Provisional application No. 62/672,496, filed on May 16, 2018.

(51) Int. Cl.

| | |
|---|---|
| ***B26B 5/00*** | (2006.01) |
| ***B67B 7/16*** | (2006.01) |
| ***B25G 1/08*** | (2006.01) |
| ***B26B 11/00*** | (2006.01) |

(52) U.S. Cl.

CPC ..... *B26B 5/003* (2013.01); *B25G 1/08* (2013.01); *B26B 11/00* (2013.01); *B67B 7/16* (2013.01)

(58) Field of Classification Search

CPC .. B26B 5/003; B26B 1/08; B26B 1/10; B26B 11/00; B67B 7/16; B25G 1/08

USPC ..... 30/62–68, 15, 156, 163, 298

See application file for complete search history.

(56) References Cited

U.S. PATENT DOCUMENTS

| | | | | |
|---|---|---|---|---|
| 2,260,141 | A * | 10/1941 | Hanle | B26B 1/06 30/163 |
| 3,660,895 | A | 5/1972 | West | |
| 4,265,017 | A | 5/1981 | Collins | |
| 5,044,079 | A * | 9/1991 | Gibbs | B26B 1/042 30/158 |
| 2005/0204567 | A1 | 9/2005 | Ping | |
| 2010/0281696 | A1 | 11/2010 | Hao et al. | |
| 2011/0308090 | A1 | 12/2011 | Ho | |
| 2012/0192434 | A1 * | 8/2012 | Syrjala | B26B 1/08 30/162 |
| 2014/0373363 | A1 | 12/2014 | Billado, Jr. | |

* cited by examiner

*Primary Examiner* — Andrea L Wellington
*Assistant Examiner* — Liang Dong
(74) *Attorney, Agent, or Firm* — Quickpatents, LLC; Kevin Prince

(57) ABSTRACT

A utility knife includes a housing with multiple interior spaces, each for holding a utility blade slidably therein. A U-shaped spring-clip has two ends rotationally fixed with the housing. A catch section of the spring clip traverses a retention slot formed in the housing. The spring clip may be pushed from an inward position into an outward position to allow the utility blade to pass from the interior space out through a slot to exit an end of the housing. When the spring clip is released with a retaining notch of the utility blade aligned with the retention slot, the retaining clip engages the retaining notch to capture the utility blade in a deployed position. Preferably the housing comprises several thin metal plates stacked together and fastened with a plurality of mechanical fasteners.

19 Claims, 11 Drawing Sheets

UTILITY KNIFE

CROSS-REFERENCE TO RELATED APPLICATIONS

This application claims the benefit of U.S. Provisional Patent Application 62/672,496, filed on May 16, 2018, and incorporated herein by reference.

STATEMENT REGARDING FEDERALLY SPONSORED RESEARCH AND DEVELOPMENT

Not Applicable.

FIELD OF THE INVENTION

This invention relates to knives, and more particularly to a utility knife with integrated blade storage and quick deployment.

DISCUSSION OF RELATED ART

Utility knives, sometimes also referred to as "box cutters" or "box cutting knives," are well known tools for facilitating the cutting of all types of objects, such as cardboard, carpet, vinyl flooring, straps, string, and the like. Frequently the razor-blade type blades of such knives quickly become dull, requiring the blade to be flipped over internal to the knife or, if both sides of the blade are dull, replacing the blade with a new one. However, conventional utility knives require two half-shells to be separated by unscrewing a screw, removing the blade or flipping the blade over, and reassembling the two half-shells. Not only might this process require a screwdriver in most cases, but removing and reinstalling the blades in such conventional utility knives is difficult as a blade must be precisely aligned with a blade carrier, which is often challenging.

Therefore, there is a need for a utility knife that allows a user to quickly deploy, retract, exchange, or flip-over a utility blade. Such a needed device would be able to store multiple blades simultaneously, each being a different type as the user sees fit. Such a needed invention would also be relatively inexpensive to manufacture and intuitive to use. The present invention accomplishes these objectives.

SUMMARY OF THE INVENTION

The present device is a utility knife for use with at least one utility blade of the type having a sharpened first edge and at least one retaining notch in an opposing second edge. A housing has a first side, a second side, a front end, a rear end, a top side, a bottom side, and at least one interior space for holding one of the at least one utility blades. The front end, and additionally in some embodiments the rear end, each have at least one slot through which the utility blade traverses.

As such, to load the utility knife with one or more utility blades, each blade is inserted into one of the slots until the blades are all in a stowed position. The first side, and in some embodiments the second side, each include an aperture therethrough to the at least one interior space. A magnet is preferably fixed at the rear end of the interior space to retain the at least one utility blade in the stowed position until a user slides the at least one utility blade out towards the slot by pressing against the at least one utility blade with his finger through the aperture (aperture preferably being an elongated oval or rectangle for this purpose).

Preferably a spring-clip is generally U-shaped and both a first and a second end are rotationally fixed with the housing. The spring clip further includes a catch section that traverses a retention slot formed in the housing. The spring clip may be pushed by a user from the inward position into an outward position to allow the utility blade to pass from the interior space out through the slot to exit the housing. When the spring clip is released with the at least one retaining notch of the utility blade aligned with the retention slot, the catch section of the retaining clip engages the at least one retaining notch of the utility blade to capture the utility blade in place in a deployed position. Replacing a dull utility blade is easily accomplished by sliding the utility blade out of the housing by holding the spring clip in the outward position to allow the utility blade to completely clear the catch section of the spring clip. A new utility blade may then be inserted into the housing by inserting the new utility blade into an empty one of the interior spaces through its associated slot in either the front end or the rear end, keeping the spring clip in the outward position to allow the retaining notches of the utility blade to pass across the retention slot and the catch section of the spring clip.

Preferably the housing comprises several thin metal plates stacked together and fastened with a plurality of mechanical fasteners, such as bolts and nuts, through a plurality of cooperative fastening apertures traversing the plates. For example, the first side is formed with a rigid first plate out of a metal sheet material or from a metal casting process. Likewise, the second side is formed with a rigid second plate out of a metal sheet material or from a metal casting process. Multiple spacer plates separated by dividing plates may be included to create a plurality of the interior spaces and slots open to either the front end or the rear end of the housing.

In a preferred embodiment capable of holding eight of the utility blades, the housing has a front aperture with four of the interior spaces and slots in the front end, and four of the interior spaces and slots in the rear end, the front end being an inverted mirror image of the rear end. Such an embodiment includes a forward spring clip slidably contained within a front retention slot, and an inverted rear spring clip slidably contained within a rear retention slot. A variety of different types of the utility blades can be loaded into such an embodiment and used as necessary.

The present device is a utility knife that allows a user to quickly deploy, retract, exchange, or flip-over a utility blade. The present invention has the capacity to store multiple blades simultaneously, each being a different type as the user sees fit. The present device is relatively inexpensive to manufacture and intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 4:
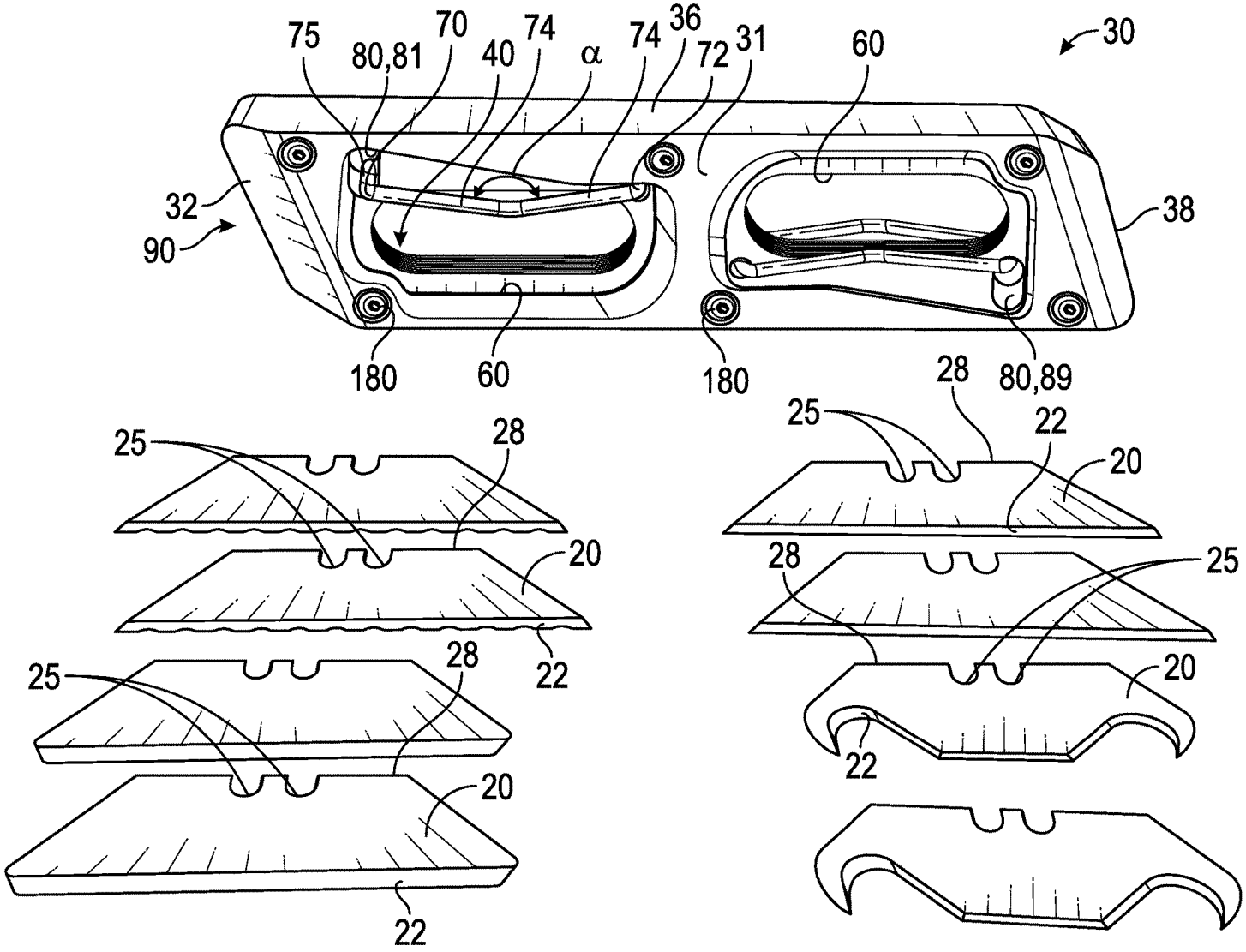
FIG. 4 is a perspective view of the embodiment of FIG. 1 showing the eight blades as removed from a housing of the invention.
Figure 5:
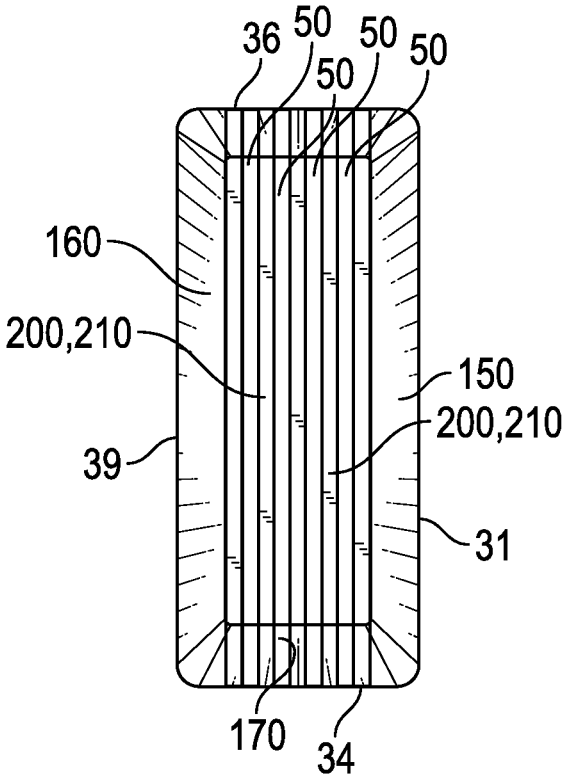
FIG. 5 is a front elevational view of the embodiment of FIG. 1.

FIGS. 1-5 illustrate one embodiment a utility knife for use with at least one utility blade 20 of the type having a sharpened first edge 22 and at least one retaining notch 25 in an opposing second edge 28. As illustrated in FIG. 4, with multiple blades 20, the blades 20 may be different types of blades 20, provided they each have the at least one retaining notch 25.

Figure 6:
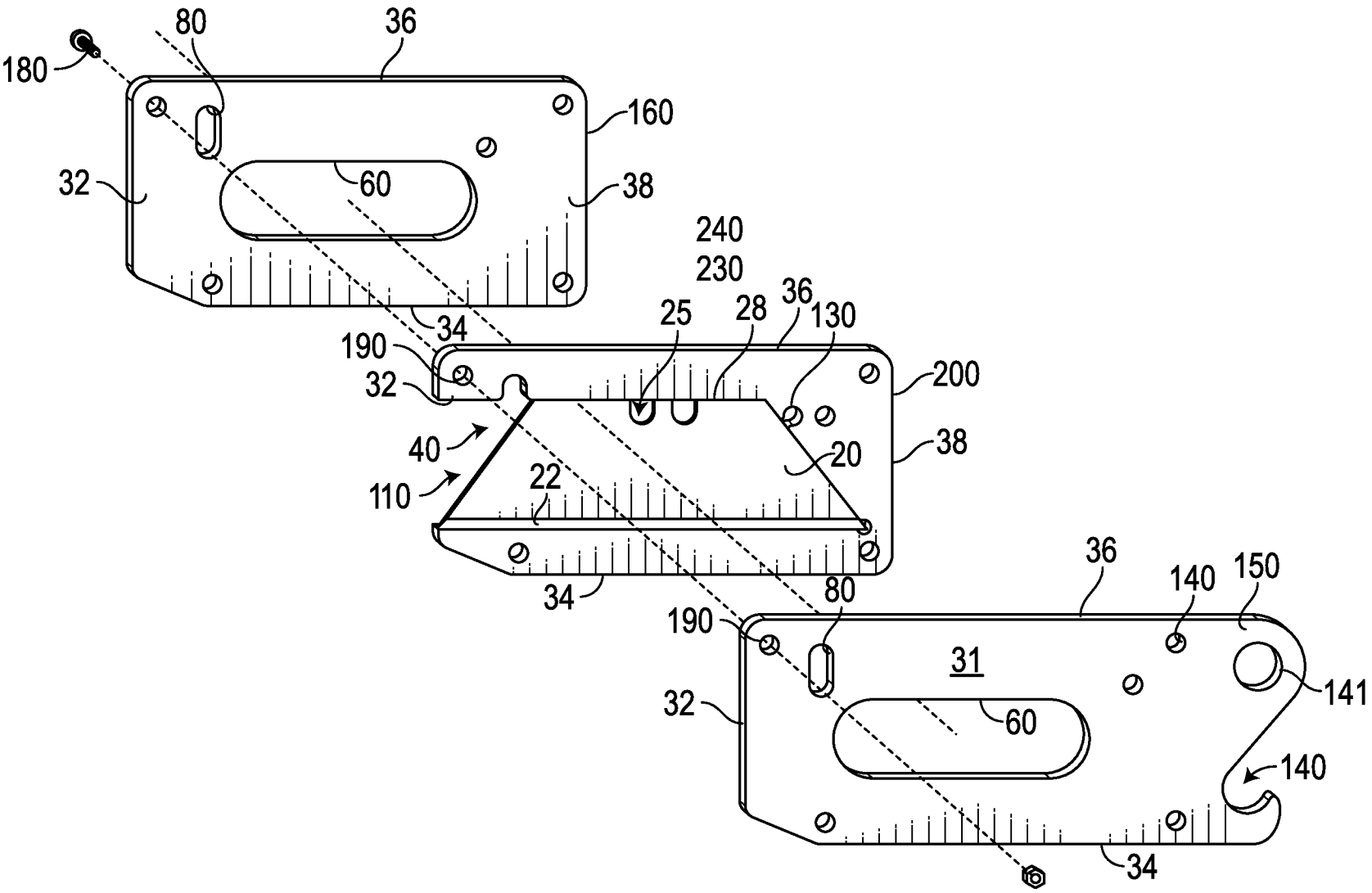
FIG. 6 is an exploded side elevational view of the invention, illustrating an alternate embodiment.
Figure 7:
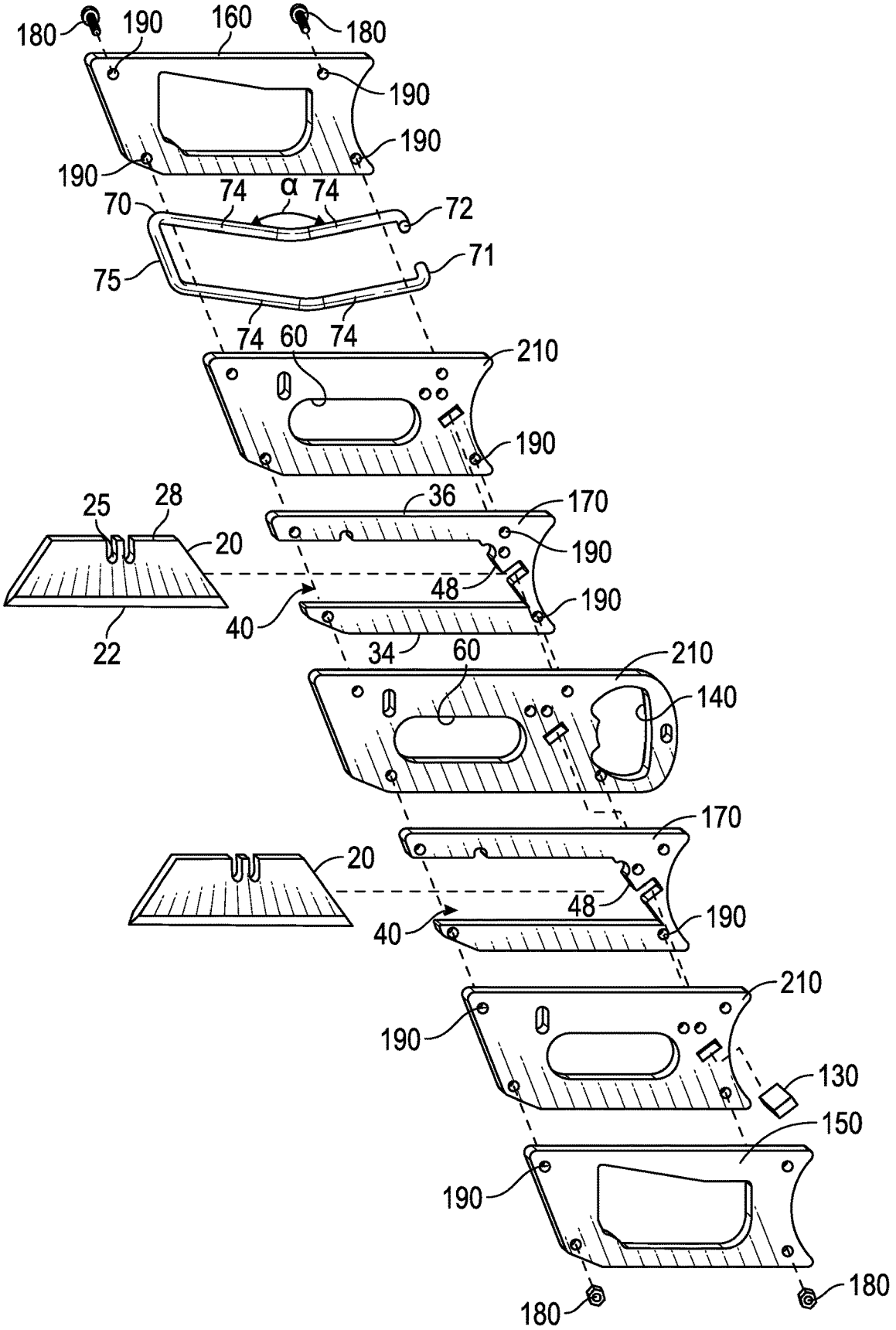
FIG. 7 is an exploded perspective view of the invention, illustrating another alternate embodiment.
Figure 8:
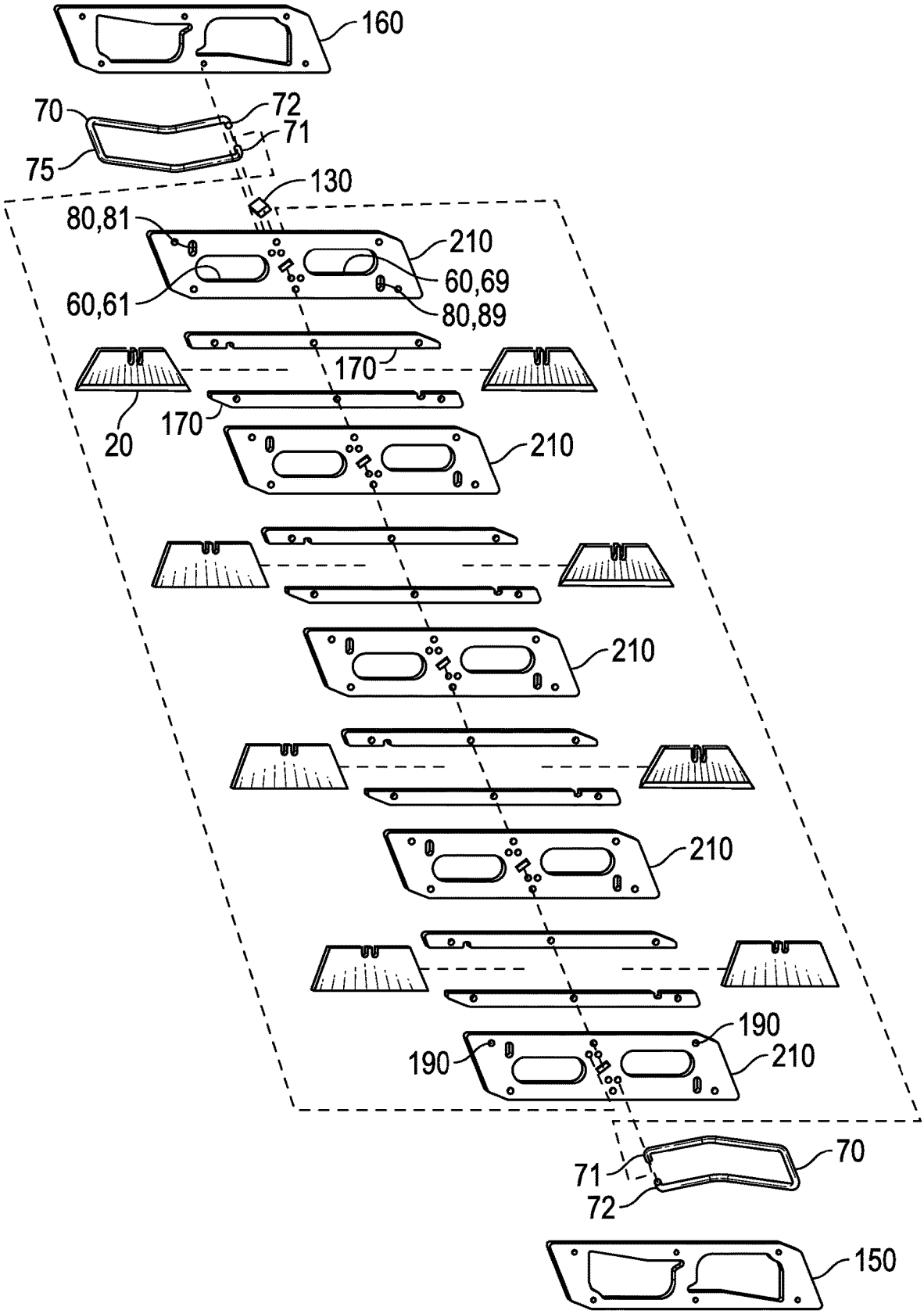
FIG. 8 is an exploded perspective view of the embodiment of FIG. 1.

A housing 30 has a first side 31, a second side 39, a front end 32, a rear end 38, a top side 36, a bottom side 34, and at least one interior space 40 for holding one of the at least one utility blades 20. The front end 32, and additionally in some embodiments the rear end 38, each have at least one slot 50 through which the utility blade 20 traverses. In some embodiments a keychain aperture 141 and/or a bottle opener 140 (FIGS. 6 and 7) project away from the rear end 38 of the housing 30.

As such, to load the utility knife 10 with one or more utility blades 20, each blade is inserted into one of the slots 50 until the blades are all in a stowed position 110. The first side 31, and in some embodiments the second side 39, each include an aperture 60 therethrough to the at least one interior space 40. A magnet 130 may be fixed at the rear end 38 of the interior space 40 to retain the at least one utility blade 20 in the stowed position 110 until a user 15 slides the at least one utility blade 20 out towards the slot 50 by pressing against the at least one utility blade 20 with his finger through the aperture 60 (aperture 60 preferably being an elongated oval or rectangle for this purpose).

A spring clip 70 has a first end 72 rotationally fixed with the housing 30 and a second end 78. The spring clip 70 spans at least partially across the aperture 60 and traverses the housing 30 at the second end 78 through a retention slot 80 traversing the housing 30 from the first side 31 to the second side 39. The spring clip 70 is urged towards the aperture 60 into an inward position 90 (FIG. 1), wherein, in one embodiment, the second end 78 of the spring clip 70 restrains the blade 20 from sliding within the interior space 40. Preferably and alternately, the spring clip 70 is generally U-shaped and both the first and second ends 72,78 are rotationally fixed with the housing 30, but offset a bit from each other to create a spring force within the spring clip 70. In such a preferred embodiment the spring clip 70 further includes a catch section 75 that traverses the retention slot 80. In some embodiments the spring clip 70 has two linear segments 74 between the catch section 75 and each of the two ends 72,78. In such an embodiment each linear segment 74 mutually meets to form an obtuse angle $\alpha$.

Figure 1:
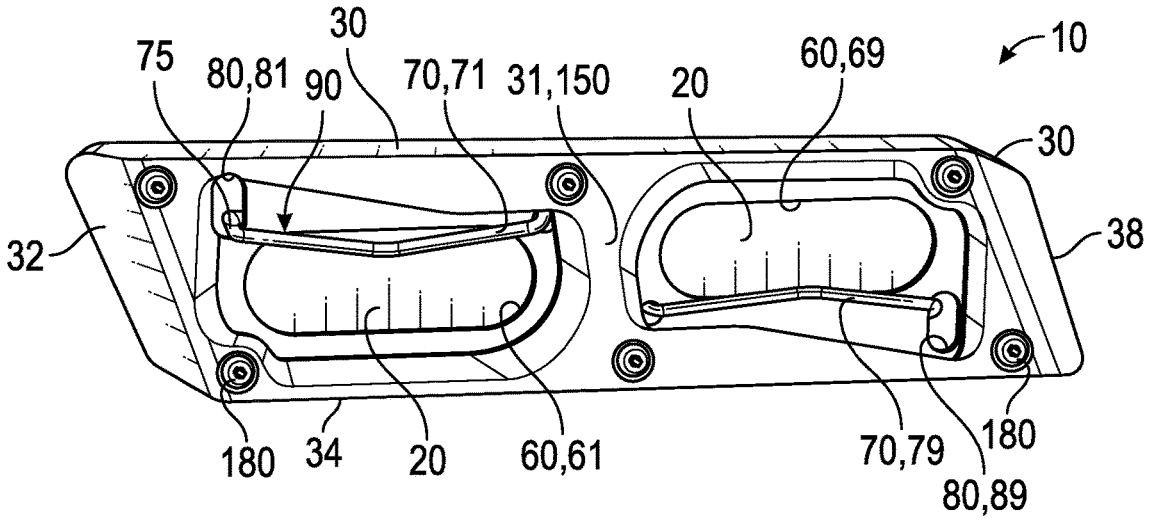
FIG. 1 is a side elevational view of one embodiment of the present invention.
Figure 2:
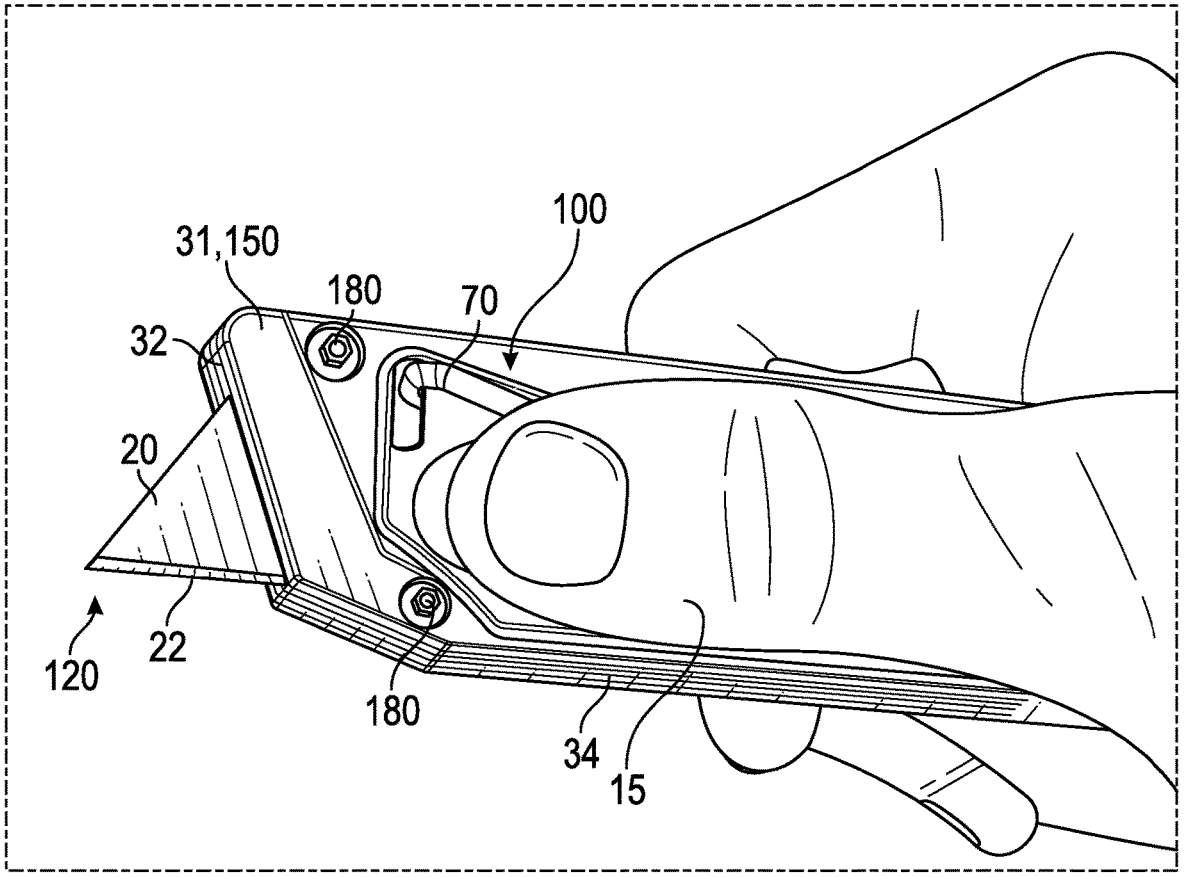
FIG. 2 is a perspective view of the embodiment of FIG. 1, illustrating a blade in a deployed position.
Figure 3:
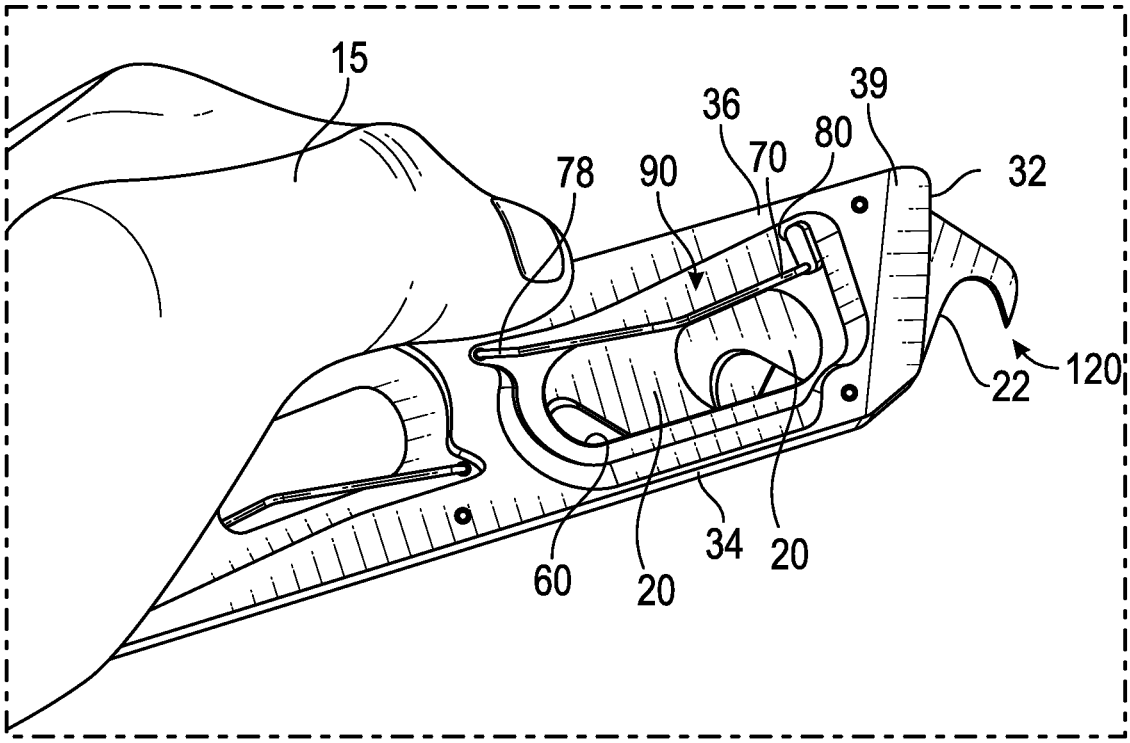
FIG. 3 is a perspective view of the embodiment of FIG. 2 but from a reverse angle, showing an alternate blade in the deployed position.

The spring clip 70 may be pushed by a user 15 from the inward position 90 (FIG. 3) into an outward position 100 to allow the utility blade 20 to pass from the interior space 40 out through the slot 50 to exit the housing 30. When the spring clip 70 is released with the at least one retaining notch 25 of the utility blade 20 aligned with the retention slot 80, the catch section 75 of the spring clip 70 engages the at least one retaining notch 25 of the utility blade 20 to capture the utility blade 20 in place in a deployed position 120 (FIG. 2). Replacing a dull utility blade 20 is easily accomplished by sliding the utility blade 20 out of the housing 30 by holding the spring clip 70 in the outward position 100 to allow the utility blade 20 to completely clear the catch section 75 of the spring clip 70. A new utility blade 20 may then be inserted into the housing by inserting the new utility blade 20 into an empty one of the interior spaces 40 through its associated slot 50 in either the front end 32 or the rear end 38, keeping the spring clip 70 in the outward position 100 to allow the retaining notches 25 of the utility blade 20 to pass across the retention slot 80 and the catch section 75 of the spring clip 70.

Preferably the housing 30 comprises several thin metal plates stacked together and fastened with a plurality of mechanical fasteners 180, such as bolts and nuts, through a plurality of cooperative fastening apertures 190 (FIGS. 5-8) traversing the plates. For example, the first side 31 is formed with a rigid first plate 150 out of a metal sheet material or from a metal casting process. Likewise, the second side 39 is formed with a rigid second plate 160 out of a metal sheet material or from a metal casting process. Multiple spacer plates 170 separated by dividing plates 210 may be included to create a plurality of the interior spaces 40 and slots 50 open to either the front end 32 or the rear end 38 of the housing 30.

In a preferred embodiment (FIGS. 1-5 and 8) capable of holding eight of the utility blades 20, the housing 30 has a front aperture 61 with four of the interior spaces 40 and slots 50 in the front end 32, and four of the interior spaces 40 and slots 50 in the rear end 38, the front end 32 being an inverted mirror image of the rear end 38. Such an embodiment includes a forward spring clip 71 slidably contained within a front retention slot 81, and an inverted rear spring clip 79 slidably contained within a rear retention slot 89. A variety of different types of the utility blades 20 can be loaded into such an embodiment and used as necessary.

Figure 9A:
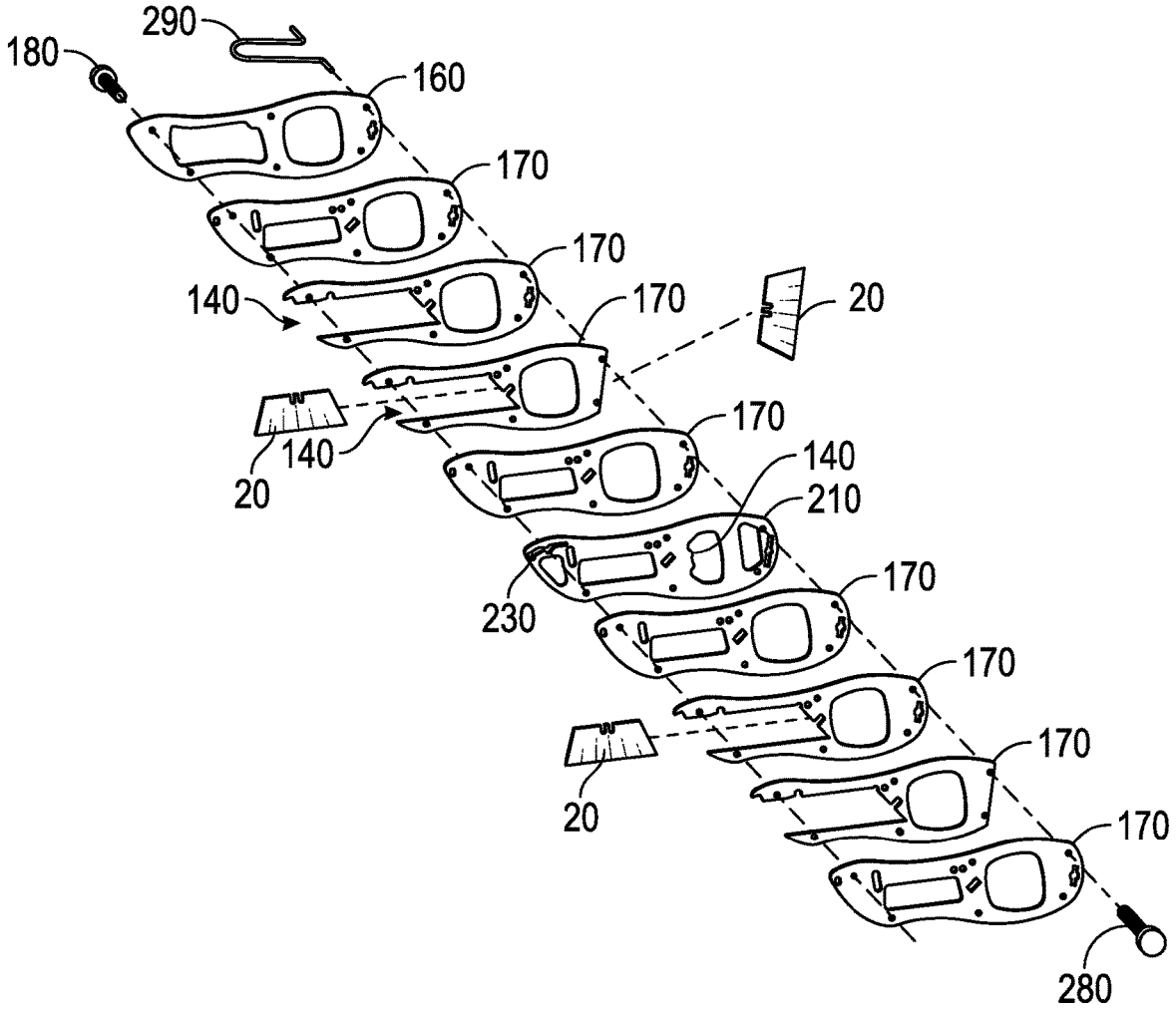
FIG. 9A is an exploded perspective view of an alternate embodiment with a scraper configuration.
Figure 9B:
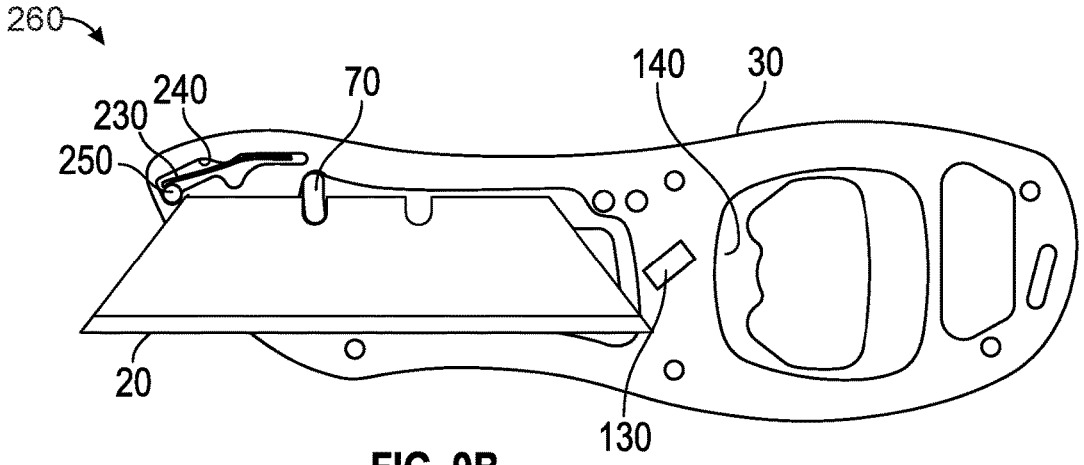
FIG. 9B is a side elevational view of the embodiment of FIG. 9A with one side removed for clarity of illustration.
Figure 10A:
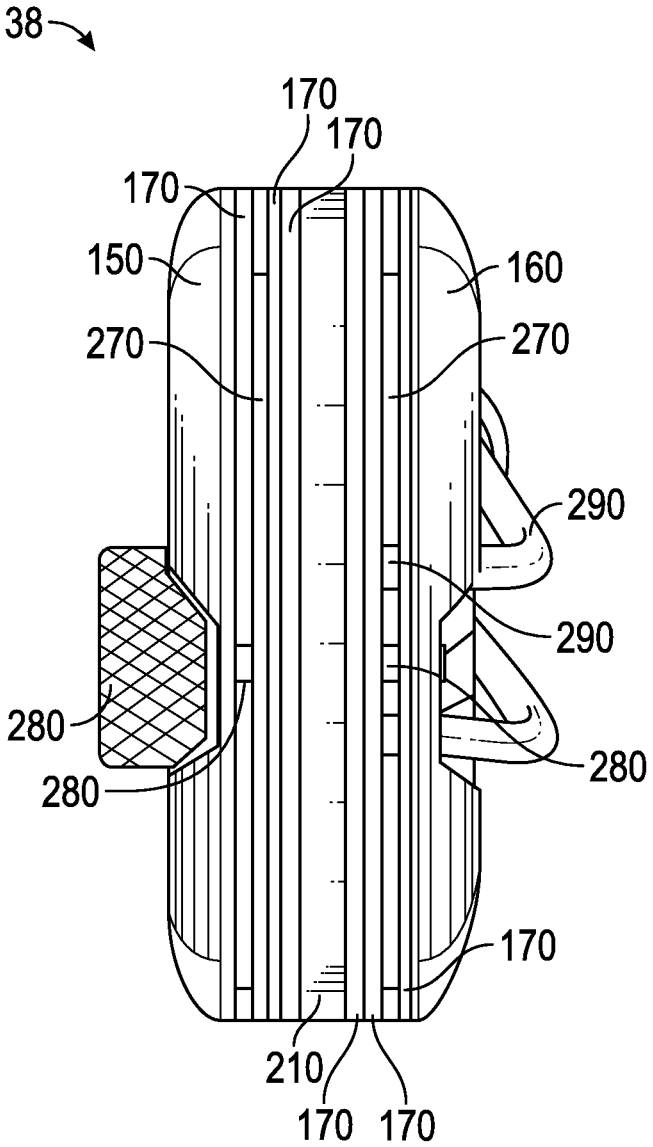
FIG. 10A is a rear elevational view of the embodiment of FIG. 9A, showing a blade gap for receiving the blade therein.
Figure 10B:
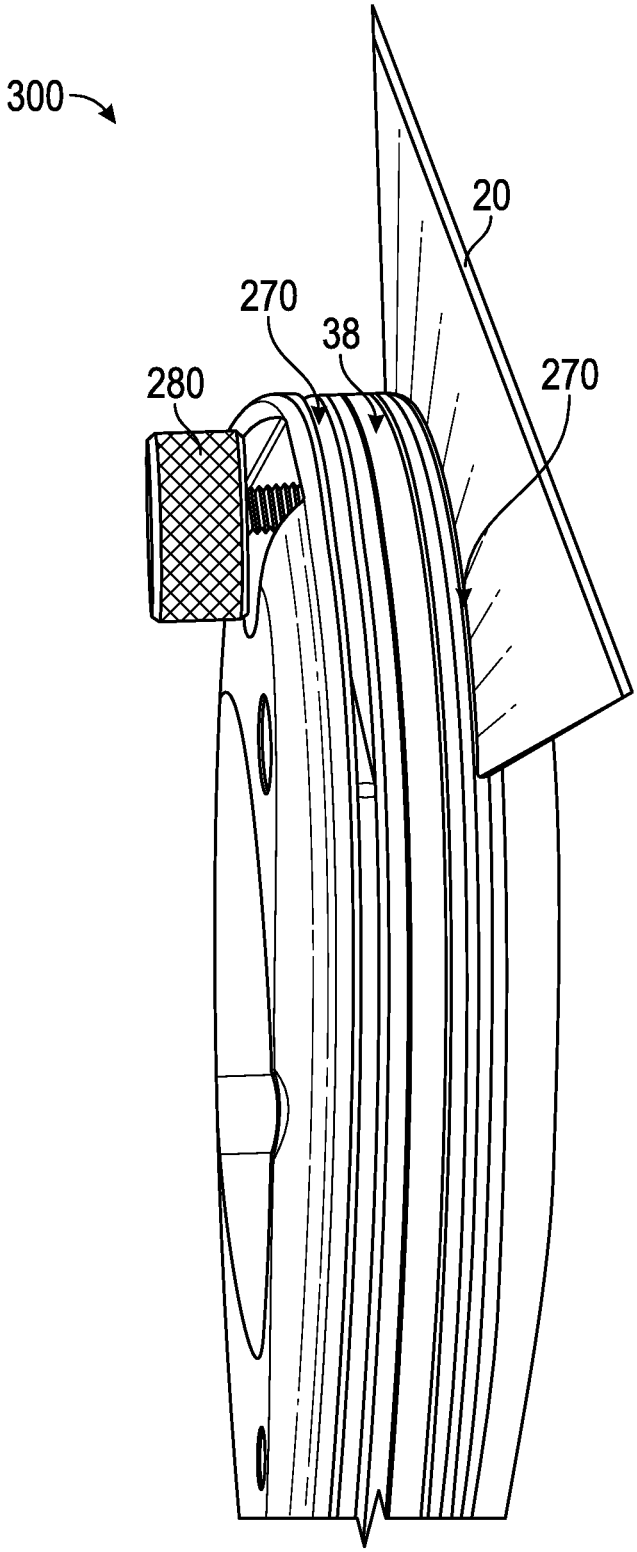
FIG. 10B is a partial rear perspective view of the embodiment of FIG. 9A, illustrate the blade as fixed within one of the gaps.
Figure 10C:
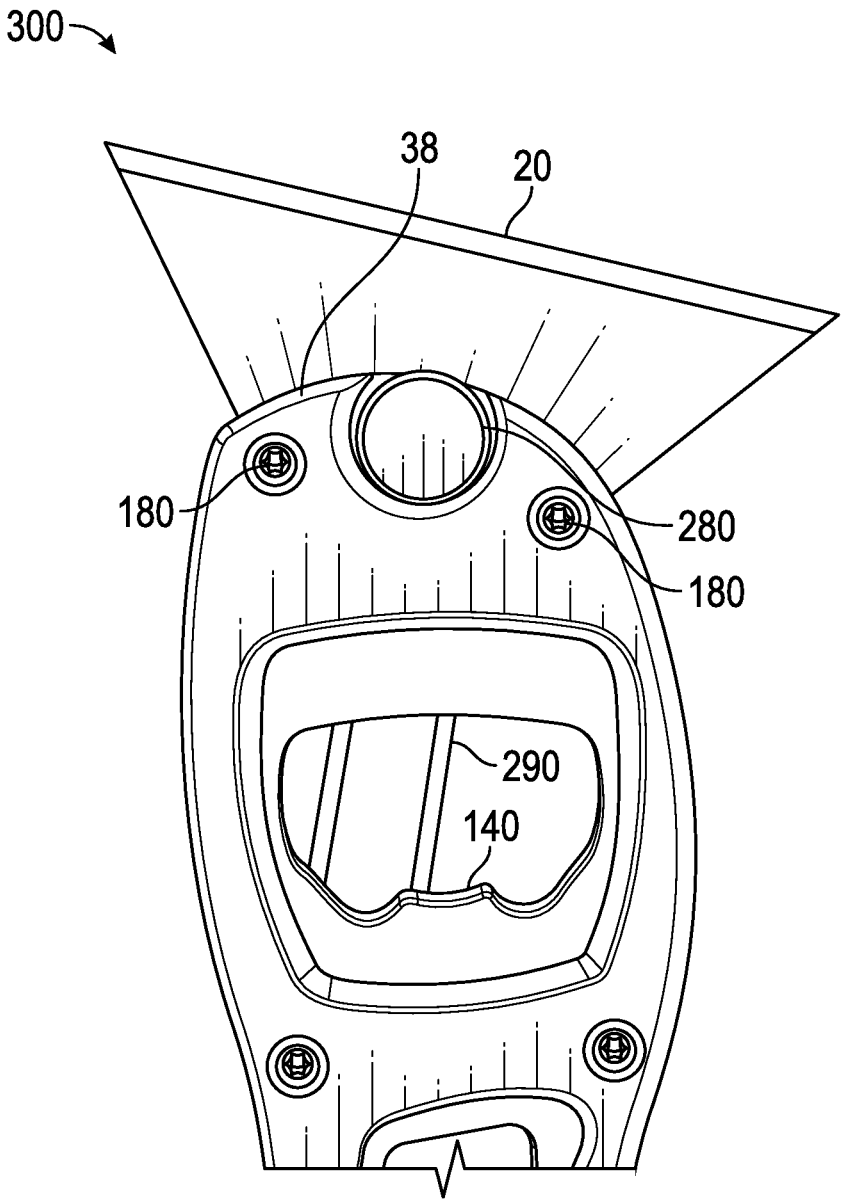
FIG. 10C is a partial front elevational view of the embodiment of FIG. 9A.

In any of the embodiments, a tension mechanism 260 (FIGS. 9A and 9B) may be included to retain the utility blade 20 within the housing 30 if the spring clip 70 is released from the utility blade 20. A tension slot 230 traverses the housing 30 between the first side 31 and the second side 39, the tension slot 230 transverse to the second edge 28 of the utility blade 20. A tension spring 240 urges a tension pin 250 towards the utility blade 20 to maintain tension on the utility blade 20 even when the spring clip 70 has been manually release from the utility blade 20, whereby the utility blade 20 must still be manually ejected from the housing 30 by pressing the utility blade 20 to overcome the tension in the tension spring 240 and allow the utility blade 20 to slide past the tension pin 250. The tension slot 230 is sized and shaped so as to prevent the tension pin 250 from escaping the tension slot 230 and falling into one of the retaining notches 25 of the utility blade 20, for example. The front side 31 and the second side 39 of the housing 30 do not have the tension slot 230 so as to prevent the tension pin 250 from sliding out of the housing 30 laterally. Clearly such a tension mechanism 260 can be utilized in any embodiment having a single, double, quadruple, or more of the utility blades 20.

In some embodiments, the rear end 38 of the housing 30 includes a blade gap 270 (FIGS. 9A, 10A-10C) formed in at least one of the spacer plates 170 such that a blade 20 can be held in a scraper configuration 300 therein with a tensioning fastener 280 and a belt clip 290. The tensioning fastener 280, such as a thumb screw, can be unscrewed to relieve tension in the plates 150,160,170,210 and allowing the blade 20 to be inserted second edge 28 first in the scraper configuration 300. The at least one retaining notch 25 engages the belt clip 290 to prevent lateral translation of the blade 20 when engaged in the blade gap 270 in the scraper configuration 300, and the tensioning fastener 280 is tightened to hold the blade 20 firmly in the blade gap 270.

While a particular form of the invention has been illustrated and described, it will be apparent that various modifications can be made without departing from the spirit and scope of the invention. For example, a different number of interior spaces 40 may be included to change the blade capacity of the utility knife from one, two, four, or eight to some other number of blades. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A utility knife for use with a utility blade of the type having a sharpened first edge and at least one retaining notch in an opposing second edge, the utility knife comprising:

a housing having a first side and a second side, a front end, a rear end, a top side, a bottom side, and an interior space within, the interior space for holding the utility blade, the front end of the housing including a slot through which the utility blade traverses, the first side including an aperture therethrough to the interior space;

a spring clip having a first end rotationally fixed with the housing and a second end, the spring clip spanning at least partially across the aperture and traversing the housing at the second end through a retention slot traversing the housing from the first side to the second side, the spring clip urged towards the aperture into an inward position wherein the second end of the spring clip restrains the blade from sliding within the interior space, the spring clip being U-shaped and wherein the first and second ends thereof are rotationally fixed with the housing, the spring clip further including a catch section that traverses the retention slot;

whereby with the utility blade in a stowed position within the interior space of the housing, the spring clip is pressed outward away from the aperture into an outward position to allow the at least one retaining notch of the blade clear the spring clip, the blade slidable forward partially through the slot until the at least one retaining notch of the blade is aligned with the retention slot, whereupon the spring clip is released to engage the at least one retaining notch of the blade to fix the blade in a deployed position partially extending through the slot.

2. The utility knife of claim 1 wherein the spring clip has two linear segments between the catch section and each of the two ends, each linear segment meeting the other linear segment at an obtuse angle.

3. The utility knife of claim 2 wherein the second side includes the aperture therethrough, the apertures of the first and second sides mutually aligned.

4. The utility knife of claim 1 wherein the housing further includes a magnet fixed at the rear end of the interior space, the magnet adapted to fix the utility blade in place when the spring clip is raised to the outward position.

5. The utility knife of claim 1 further including a bottle opener projecting away from the rear end of the housing.

6. The utility knife of claim 1 wherein the first side is formed with a rigid first plate, the second side is formed with a rigid second plate, and wherein the top side, bottom side, and rear end include an integrally-formed rigid spacer plate, the interior space being defined between the first, second and spacer plates, all of the plates being mechanically fastened together with a plurality of mechanical fasteners traversing a plurality of aligned fastening apertures traversing the plates.

7. The utility knife of claim 1 further including a tension mechanism that includes a tension slot traverses the housing between the first side and the second side, the tension slot transverse to the second edge of the utility blade, a tension spring 240 urging a tension pin towards the second edge of the utility blade to maintain tension on the utility blade when the spring clip is manually released from the utility blade 20, whereby the utility blade may be manually ejected from the housing by pushing the utility blade to overcome the tension in the tension spring to allow the utility blade to slide past the tension pin.

8. A utility knife for use with at least two utility blades of the type having a sharpened first edge and at least one retaining notch in an opposing second edge, the utility knife comprising:

a housing having a first side and a second side, a front end, a rear end, a top side, a bottom side, and at least two interior spaces within, each interior space separated by a dividing wall, each interior space for holding one of the utility blades, the front end of the housing including at least two slots, each slot for receiving one of the utility blades into one of the interior spaces, the first side and second side each including an aperture therethrough to one of the interior spaces, the apertures each mutually aligned;

a spring clip having a first end rotationally fixed with the first side of the housing and a second end rotationally fixed with the second side of the housing, the spring clip being U-shaped and spanning at least partially across the apertures and traversing the housing at a catch portion of the spring clip through a retention slot traversing the housing from the first side to the second side, the spring clip urged towards the apertures into an inward position wherein the catch portion of the spring clip restrains the blade from sliding within the interior space;

whereby with the at least two utility blades in a stowed position within the at least two interior spaces of the housing, the spring clip is pressed outward away from the apertures into an outward position to allow the at least one retaining notch of a corresponding one of the blades to clear the spring clip, the blade slidable forward partially through the slot until the at least one retaining notch of the blade is aligned with the retention slot, whereupon the spring clip is released to engage the at least one retaining notch of the blade to fix the blade in a deployed position partially extending through the slot.

9. The utility knife of claim 8 wherein the spring clip has two linear segments between the catch section and each of the two ends, each linear segment meeting the other linear segment at an obtuse angle.

10. The utility knife of claim 8 wherein the housing further includes a magnet fixed at the rear end of the interior spaces, the magnet adapted to fix the utility blades in place when the spring clip is raised to the outward position.

11. The utility knife of claim 8 wherein the first side is formed with a rigid first plate, the second side is formed with a rigid second plate, and wherein the top side, bottom side, and rear end include two integrally-formed rigid spacer plates, the interior spaces each being defined between the spacer plates, a dividing plate, and either the first or second plate, the plates all being mechanically fastened together with a plurality of mechanical fasteners traversing a plurality of aligned fastening apertures traversing the plates.

12. A utility knife for use with at least four utility blades of the type having a sharpened first edge and at least one retaining notch in an opposing second edge, the utility knife comprising:

a housing having a first side and a second side, a front end, a rear end, a top side, a bottom side, and at least four interior spaces within, each interior space separated by a dividing wall, each interior space for holding one of the utility blades, the front and rear ends of the housing each including at least two slots, each slot for receiving one of the utility blades into one of the interior spaces, the first side, second side and each dividing wall including two front and rear apertures therethrough, each aperture open to one or two of the interior spaces, a front apertures each mutually aligned and the rear apertures each mutually aligned;

a front spring clip and a rear spring clip, each having a first end rotationally fixed with the first side of the housing and a second end rotationally fixed with the second side of the housing, each spring clip being U-shaped and spanning at least partially across either the front apertures or the rear apertures and traversing the housing at a catch portion of the spring clip through either a front retention slot or a rear retention slot traversing the housing from the first side to the second side, each spring clip urged towards either the front or rear apertures into an inward position wherein the catch portion of the spring clip restrains the blades from sliding within the interior spaces;

whereby with the at least four utility blades stored within the at least four interior spaces of the housing, either spring clip may be pressed outwardly away from the apertures into an outward position to allow the at least one retaining notch of one of the blades to clear the spring clip, the blade slidable forward partially through the slot until the at least one retaining notch of the blade is aligned with the corresponding retention slot, whereupon the spring clip is released to engage the at least one retaining notch of the blade to fix the blade in a deployed position partially extending through the slot of either the front or rear end of the housing.

13. The utility knife of claim 12 wherein the front apertures and front spring clip, from either the first side or the second side, form an inverted mirror image of the rear apertures and rear spring clip.

14. The utility knife of claim 12 wherein each spring clip has two linear segments between the catch section and each of the two ends, each linear segment meeting the other linear segment at an obtuse angle.

15. The utility knife of claim 12 wherein the housing further includes a magnet fixed at the rear end of the interior spaces, the magnet adapted to fix the utility blades in place when each of the spring clips is raised to the outward position.

16. The utility knife of claim 12 wherein the first side is formed with a rigid first plate, the second side is formed with a rigid second plate, and wherein the top side, bottom side, and rear end include an integrally-formed rigid spacer plate, the interior space being defined between the first, second and spacer plates, the plates all being mechanically fastened together with a plurality of mechanical fasteners traversing a plurality of aligned fastening apertures traversing the plates.

17. The utility knife of claim 12 wherein the first side is formed with a rigid first plate, the second side is formed with a rigid second plate, and wherein the top side and bottom side each include a plurality of spacer plates, the interior spaces each being defined between the spacer plates, one of a plurality of dividing plates, and either the first or second plate, the plates all being mechanically fastened together with a plurality of mechanical fasteners traversing a plurality of aligned fastening apertures traversing the plates.

18. The utility knife of claim 17 wherein each of the interior spaces are defined between the spacer plates and two of the dividing plates, the front and rear plates each being fixed with one of the dividing plates.

19. The utility knife of claim 17 wherein the rear end of the housing includes a blade gap formed in at least one of the spacer plates such that a blade can be held in a scraper configuration therein with a tensioning fastener and a belt clip.

* * * * *